US007831192B2

(12) United States Patent
Omura et al.

(10) Patent No.: US 7,831,192 B2
(45) Date of Patent: Nov. 9, 2010

(54) IMAGE FORMING APPARATUS

(75) Inventors: Hiroyoshi Omura, Osaka (JP); Yoshihiro Andou, Osaka (JP)

(73) Assignee: Kyocera Mita Corporation (JP)

( * ) Notice: Subject to any disclaimer, the term of this patent is extended or adjusted under 35 U.S.C. 154(b) by 771 days.

(21) Appl. No.: 11/789,914

(22) Filed: Apr. 26, 2007

(65) Prior Publication Data

US 2007/0264065 A1 Nov. 15, 2007

(30) Foreign Application Priority Data

Apr. 27, 2006 (JP) ..... 2006-123738

(51) Int. Cl.
*G03G 15/00* (2006.01)

(52) U.S. Cl. ..... 399/391; 399/392

(58) Field of Classification Search ..... 399/179, 399/223, 299, 300, 303, 391
See application file for complete search history.

(56) References Cited

U.S. PATENT DOCUMENTS 3,762,323 A * 10/1973 Hartka et al. ..... 101/350.1
4,530,596 A * 7/1985 Kawamoto et al. ..... 399/357
5,221,944 A * 6/1993 Yoda et al. ..... 399/233
5,927,205 A * 7/1999 Jentzsch et al. ..... 101/424
7,346,307 B2 * 3/2008 Honda et al. ..... 399/349
2001/0018003 A1 * 8/2001 Waterschoot ..... 399/353
2003/0053824 A1 * 3/2003 Hiroki et al. ..... 399/228
2005/0212883 A1 * 9/2005 Okamoto ..... 347/104
2007/0009284 A1 * 1/2007 Okamoto et al. ..... 399/101

FOREIGN PATENT DOCUMENTS

JP 2003-131483 5/2003
JP 2004-233629 8/2004
JP 2005024786 A * 1/2005
JP 2005-91780 4/2005

* cited by examiner

*Primary Examiner*—Ren Yan
*Assistant Examiner*—Allister Primo
(74) *Attorney, Agent, or Firm*—Gerald E. Hespos; Michael J. Porco

(57) ABSTRACT

An image forming apparatus is provided with a first and a second sheet feeding sections for accommodating sheets before printing in a stacked manner; a first sheet conveying section including first conveying members and adapted to convey a sheet received from the first sheet feeding section; a second sheet conveying section including second conveying members and adapted to convey a sheet received from the second sheet feeding section; a plurality of image forming units each including driven members and adapted to form toner images of different colors; a first driving source for driving the first conveying members; and a second driving source for driving the second conveying members. Some of the driven members are driven by the first driving source and others are driven by the second driving source.

10 Claims, 4 Drawing Sheets

IMAGE FORMING APPARATUS

BACKGROUND OF THE INVENTION

1. Field of the Invention

The present invention relates to an image forming apparatus represented by a copier or a printer.

2. Description of the Related Art

An image forming apparatus such as a copier or a printer generally includes a sheet feeding section in which sheets before printing are accommodated in a stacked manner; a sheet conveying section for conveying a sheet from the sheet feeding section to a transfer unit; an image forming unit for forming a toner image; the transfer unit for transferring the toner image to the sheet; and a fixing unit for fixing the unfixed toner image to the sheet. Some of image forming apparatuses include a plurality of sheet cassettes as a sheet feeding section in a bottom part of a main body of the image forming apparatus and include an image forming unit, a transfer unit and the like in an upper part in order to minimize an installation floor area.

A sheet conveying section for conveying a sheet from the sheet cassette in the bottom part of the apparatus main body to the transfer unit and the like in the upper part is, in many cases, formed to vertically extend along a side surface of the main body for the miniaturization of the image forming apparatus, thereby forming a vertical conveyance path. Here, a manual sheet feeding section is used in the case of using sheets such as thick paper sheets or OHP sheets wished to be fed into the image forming apparatus one by one without using the sheet cassette. In order to suppress a curvature of a sheet conveyance path, the manual sheet feeding section is sometimes disposed at a side surface of the main body opposite to the one where the vertical conveyance path is formed. One example of such an image forming apparatus can be found in Japanese Unexamined Patent Publication No. 2003-131483 (document D1).

On the other hand, since the image forming unit performs an image forming operation while conveying a sheet, many conveyance rollers as conveying members for conveying the sheet and many rotary members relating to the image formation such as a photoconductive drum, a developing roller, a cleaning roller and a fixing roller are disposed at various positions. Particularly in an image forming apparatus for color printing, a plurality of image forming units are constructed due to the necessity to form toner images of different colors, which further increases the number of rotary members relating to the image formation.

The image forming apparatus is provided with a plurality of driving mechanisms for rotating these rollers and rotary members. The driving mechanisms include driving sources and power transmitting members such as motors, gears, belts and clutches. Such driving mechanisms are unitized in view of recyclability, assemblability and maintainability in some cases. One example of an image forming apparatus in which driving mechanisms for image forming units are unitized can be found in Japanese Unexamined Patent Publication No. 2005-91780 (document D2).

The image forming apparatus disclosed in document D2 is a so-called tandem-type image forming apparatus provided with four image forming units for forming toner images of different colors and an intermediate transfer belt, and the driving mechanisms for the image forming units at four positions and the intermediate transfer belt are unitized. In view of parts cost and space to be taken up upon constructing such a driving mechanism, it is desirable to rotate as many rollers and rotary members as possible by the driving mechanism constructed by a minimum number of parts.

Further, in the case of having the manual sheet feeding section at the side surface of the main body opposite to the one where the main vertical conveyance path is formed as in the image forming apparatus disclosed in document D1, the power transmitting members have to be constructed such that power can be transmitted to parts relatively distant from the driving source. This results in lower assemblability and maintainability and increases a power transmission loss to decrease driving efficiency. Accordingly, in an image forming apparatus provided with many rollers and rotary members, it is preferable to design driving mechanisms for driving the rollers and rotary members with suitable efficiency while promoting lower costs and miniaturization.

SUMMARY OF THE INVENTION

An object of the present invention is to provide an image forming apparatus that is provided with driving mechanisms promoting lower costs and miniaturization and having improved assemblability and maintainability, and that can drive a sheet conveying section and an image forming unit with suitable efficiency.

The present invention is directed to an image forming apparatus, comprising a first and a second sheet feeding sections for accommodating sheets before printing in a stacked manner; a first sheet conveying section including first conveying members and adapted to convey a sheet received from the first sheet feeding section; a second sheet conveying section including second conveying members and adapted to convey a sheet received from the second sheet feeding section; a plurality of image forming units each including driven members and adapted to form a toner image of a different color; a first driving source for driving the first conveying members; and a second driving source for driving the second conveying members, some of the driven members being driven by the first driving source and others being driven by the second driving source.

DETAILED DESCRIPTION OF THE PREFERRED EMBODIMENTS

Hereinafter, one embodiment of the present invention is described with reference to FIGS. 1 to 4.

Figure 1:
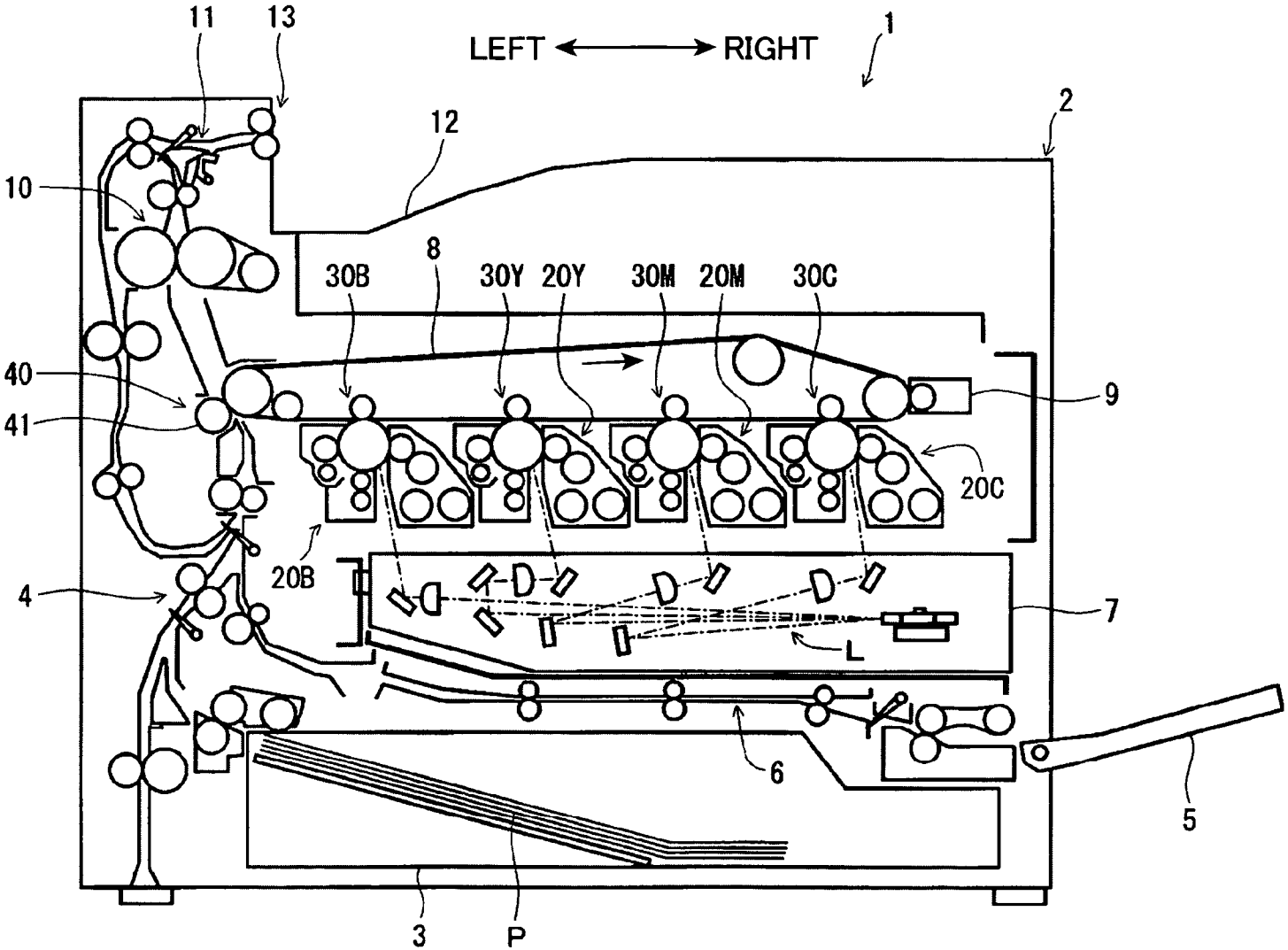
FIG. 1 is a front view in section showing the internal construction of an image forming apparatus according to one embodiment of the invention.

First, an image outputting operation of an image forming apparatus according to the embodiment of the present invention is described while the construction thereof is briefly described with reference to FIG. 1. FIG. 1 is a front view in section showing the internal construction of the image forming apparatus. This image forming apparatus is of the color printing type for transferring toner images to a sheet using an intermediate transfer belt.

As shown in FIG. 1, a sheet cassette 3 as a first sheet feeding section is arranged at an inner bottom part of a box-shaped main body 2 of the image forming apparatus 1. Sheets P such as cut sheets before printing are accommodated in a stacked manner in the sheet cassette 3. These sheets P are separated and dispensed one by one toward upper left from the sheet cassette 3 in FIG. 1. The sheet cassette 3 is horizontally withdrawable from the front side of the main body 2.

A first sheet conveying section 4 is provided to the left of the sheet cassette 3 inside the main body 2. The first sheet conveying section 4 is substantially vertically formed along the left surface (first surface) of the main body 2. The first sheet conveying section 4 receives the sheet P dispensed from the sheet cassette 3 and conveys it vertically upward along the left surface of the main body 2 to a secondary transfer portion 40. The first sheet conveying section 4 includes a feed roller and pairs of conveyance rollers (first conveying members) for the conveyance of the sheet P.

A manual sheet feeding section 5 as a second sheet feeding section is disposed above the sheet cassette 3 and at a position of the right surface (second surface) of the main body 2 opposite to the left surface where the first sheet conveying section 4 is formed. Sheets P of the size not accommodated in the sheet cassette 3, sheets P intended to be inserted one by one such as thick sheets or OHP sheets or the like are placed on the manual sheet feeding section 5.

A second sheet conveying section 6 is arranged to the left of the manual sheet feeding section 5. The second sheet conveying section 6 extends substantially horizontally from the manual sheet feeding section 5 to the first sheet conveying section 4 right above the sheet cassette 3 and joins the first sheet conveying section 4. The second sheet conveying section 6 is for receiving a sheet P or the like fed from the manual sheet feeding section 5 and conveying it substantially horizontally to the first sheet conveying section 4. The second sheet conveying section 6 likewise includes a feed roller and pairs of conveyance rollers (second conveying members) for the conveyance of the sheet P.

The image forming apparatus 1 receives a document image data from an external computer (not shown). This image data information is sent to a laser irradiation unit 7 as an exposing mechanism arranged above the second sheet conveying section 6. Laser beams L which are generated by the laser irradiation unit 7 and controlled based on the image data are irradiated toward image forming units 20.

A total of four image forming units 20 are arranged above the laser irradiation unit 7, and an intermediate transfer belt 8 that is an endless belt as an intermediate transfer member is arranged above the respective image forming units 20. The intermediate transfer belt 8 is supported by being mounted on a plurality of rollers and is turned in clockwise direction of FIG. 1 by an unillustrated driving device.

The four image forming units 20 are so-called tandem type image forming units arranged in a row along the turning direction of the intermediate transfer belt 8 from an upstream side toward a downstream side as shown in FIG. 1. The four image forming units 20 are a cyan image forming unit 20C, a magenta image forming unit 20M, a yellow image forming unit 20Y and a black image forming unit 20B in this order from the upstream side. Toner particles are resupplied to these image forming units 20 by means of toner particle supply containers corresponding to the respective colors and their conveying mechanisms (not shown). Identifying marks "C", "M", "Y" and "B" are left out unless it is necessary to particularly specify.

In each image forming unit 20, an electrostatic latent image of a document image is formed by the laser beam L irradiated by the laser irradiation unit 7, and a toner image is developed from this electrostatic latent image. The toner image is transferred as a primary transfer to the outer surface of the intermediate transfer belt 8 by a first transfer portion 30 arranged above each image forming unit 20. The toner images of the respective image forming units 20 are transferred to the intermediate transfer belt 8 at specified timings as the intermediate transfer belt 8 turns, whereby the four toner images of cyan, magenta, yellow and black are superimposed on the outer surface of the intermediate transfer belt 8 to form a color toner image.

A secondary transfer portion 40 including a secondary transfer roller 41 is arranged at a position where the intermediate transfer belt 8 faces the first sheet conveying section 4. The color toner image on the outer surface of the intermediate transfer belt 8 is transferred to the sheet P synchronously conveyed by the first sheet conveying section 4 at a secondary transfer nip portion formed by the pressing contact of the intermediate transfer belt 8 and the secondary transfer roller 41.

After the secondary transfer, toner particles remaining on the outer surface of the intermediate transfer belt 8 are cleaned and collected by a cleaning device 9 for the intermediate transfer belt 8 arranged upstream of the cyan image forming unit 20C with respect to the turning direction of the intermediate transfer belt 8.

A fixing unit 10 is disposed above the secondary transfer portion 40. The sheet P bearing the unfixed toner image in the secondary transfer portion 40 is conveyed to the fixing unit 10, where the toner image is fixed through heating and application of pressure by a heating roller and a pressure roller.

A junction portion 11 is disposed above the fixing unit 10. The sheet P discharged from the fixing unit 10 is discharged onto a sheet discharging section 12 provided atop the image forming apparatus 1 from the junction portion 11 in the case of performing no duplex printing.

A discharge port through which the sheet P is discharged form the junction portion 11 to the sheet discharging section 12 functions as a switchback portion 13. In the case of performing duplex printing, a conveying direction of the sheet P discharged from the fixing unit 10 is switched at this switchback portion 13. Then, the sheet P is conveyed downward through the junction portion 11 and the left sides of the fixing unit 10 and the secondary transfer portion 40, and is conveyed again to the secondary transfer portion 40 via the first sheet conveying section 4.

Figure 2:
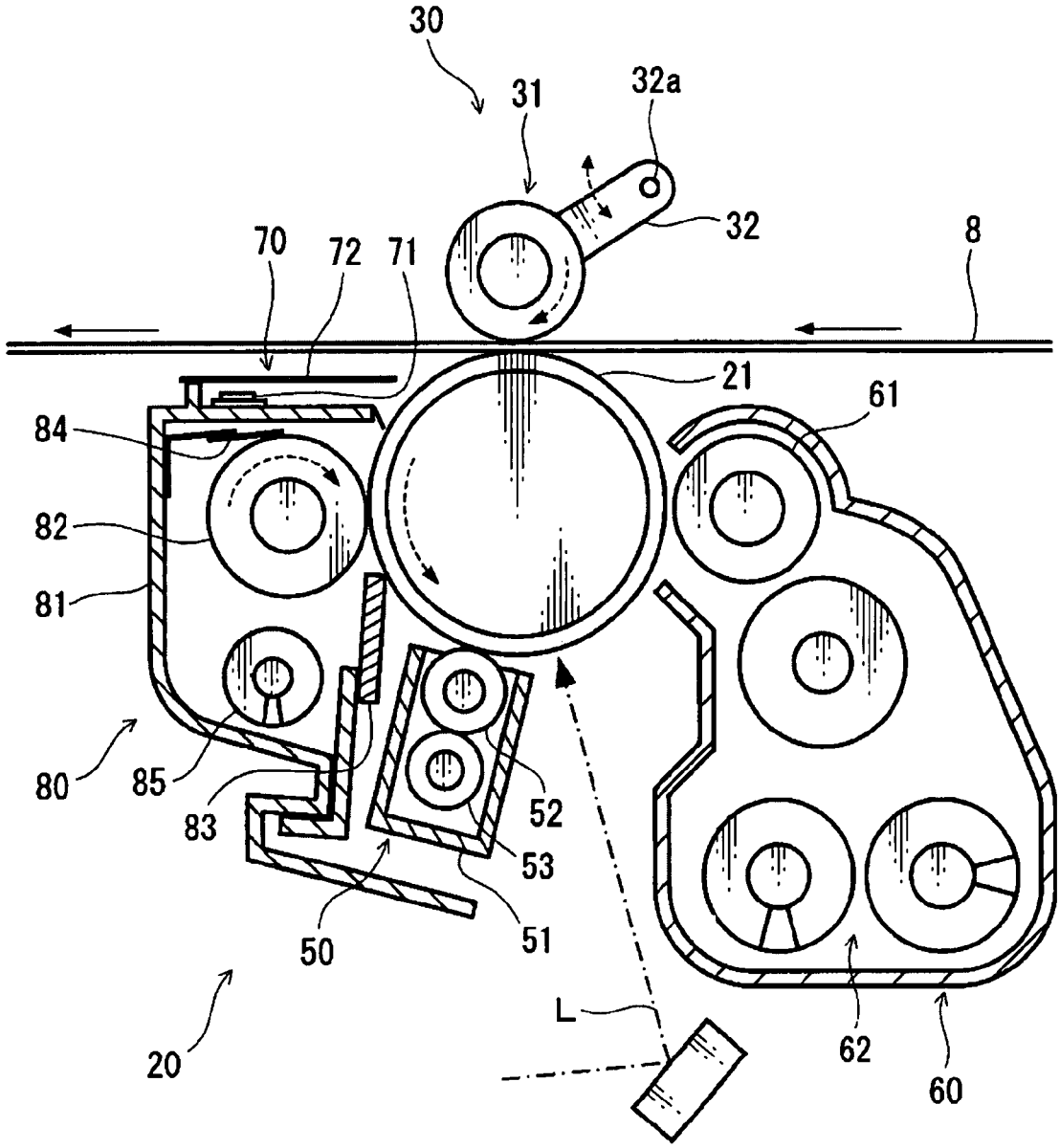
FIG. 2 is a partial enlarged section showing an image forming unit of FIG. 1 and its peripheral devices.

Next, the detailed construction of the image forming unit 20 and its peripheral devices of the image forming apparatus 1 is described with reference to FIG. 2. FIG. 2 is a partial enlarged vertical section showing the image forming unit and its peripheral devices. Since the respective image forming units 20 of four colors have a common construction, the identifying marks "C", "M", "Y" and "B" are left out as described above.

As shown in FIG. 2, the image forming unit 20 includes a photoconductive drum 21 as an image bearing member in its center. In the vicinity of the photoconductive drum 21, a charging device 50, a developing device 60, a charge removing device 70 and a cleaning device 80 for the photoconductive drum are arranged in this order along a rotating direction of the photoconductive drum 21. The primary transfer portion 30 is disposed between the developing device 60 and the charge removing device 70 along the rotating direction of the photoconductive drum 21.

The photoconductive drum 21 is an inorganic photoconductive drum having a layer of amorphous silicon, which is an inorganic photoconductive material, formed on the outer surface of an electrically conductive roller base made of aluminum or the like by vacuum deposition or the like, and the diameter thereof is, for example, 30 mm. The photoconductive drum 21 is rotated by an unillustrated driving device such that the circumferential speed thereof is substantially equal to a sheet conveying speed (e.g. 210 mm/sec).

Inside its housing 51, the charging device 50 includes a charging roller 52 held in contact with the photoconductive drum 21. The charging roller 52 is pressed in contact with the photoconductive drum 21 at a specified pressure and rotates as the photoconductive drum 21 rotates. The outer surface of the photoconductive drum 21 is uniformly charged at specified polarity and potential by this charging roller 52. It should be noted that a cleaning brush 53 is disposed at a side of the charging roller 52 opposite to the photoconductive drum 21.

In the developing device 60, a developing roller 61 that is not in contact with the photoconductive drum 21 is provided in the vicinity of the photoconductive drum 21. A bias having the same polarity as the charging polarity of the photoconductive drum 21 is applied to the developing roller 61. The toner particles as a developing agent are charged and caused to fly toward the electrostatic latent image on the outer surface of the photoconductive drum 21 by this developing roller 61, whereby the electrostatic latent image is developed. Nonmagnetic one-component toner particles are used as the toner particles, but a two-component developing agent obtained by mixing magnetic carriers and nonmagnetic toner particles may be used. The toner particles are contained in the toner supply container (not shown), conveyed to the developing device 60, and resupplied by supply screws 62. It should be noted that the developing roller 61 may be in contact with the photoconductive drum 21.

The primary transfer portion 30 includes a primary transfer roller 31 held in contact with the photoconductive drum 21 via the intermediate transfer belt 8. The primary transfer roller 31 is supported on an unillustrated frame via an arm 32. The arm 32 is pivotal about a shaft 32*a* thereof, and the primary transfer roller 31 is vertically moved by this pivotal movement.

The primary transfer roller 31 comes into contact with the intermediate transfer belt 8 upon moving downward at a specified timing, whereupon the intermediate transfer belt 8 is pressed down to come into contact with the photoconductive drum 21, thereby forming a primary transfer nip portion. When the primary transfer roller 31 moves upward, the intermediate transfer belt 8 separates from the photoconductive drum 21. Without having a driving device, the primary transfer roller 31 rotates as the intermediate transfer belt 8 turns by being held in contact with the intermediate transfer belt 8. Further, a primary transfer bias is applied to the primary transfer roller 31 according to needs.

The charge removing device 70 is arranged further downstream of the primary transfer portion 30 along the rotating direction of the photoconductive drum 21. The charge removing device 70 includes an LED (light-emitting diode) 71 and a reflector plate 72. The LED 71 is mounted on the upper surface of a housing 81 of the cleaning device 80. Instead of the LED 71, an EL (electroluminescent) light source, a fluorescent light or the like may be used. The reflector plate 72 is disposed above the LED 71 to cover the LED 71. The charge removing device 70 removes electrification charges on the outer surface of the photoconductive drum 21 by irradiating the photoconductive drum 21 with a charge removing light from the LED 71.

The cleaning device 80 includes a cleaning roller 82 as a cleaning member, a cleaning blade 83, a scraper 84 and a discharge screw 85 inside its housing 81. The cleaning roller 82 and the cleaning blade 83 have substantially the same lengths as the photoconductive drum 21 along an axis line direction (direction normal to the plane of FIG. 2), and are so arranged as to touch the photoconductive drum 21. After the primary transfer of the toner image on the outer surface of the photoconductive drum 21 to the intermediate transfer belt 8, the cleaning roller 82 and the cleaning blade 83 remove the toner particles remaining on the outer surface of the photoconductive drum 21 to clean the photoconductive drum 21. The scraper 84 is arranged to touch the cleaning roller 82 from above in FIG. 2, thereby removing superfluous toner adhering to the outer surface of the cleaning roller 82 to even the toner layer. The toner particles removed from the outer surface of the photoconductive drum 21 is conveyed toward the discharge screw 85 by the action of gravity and the rotation of the cleaning roller 82, and conveyed out of the housing 81 by the discharge screw 85.

Figure 3:
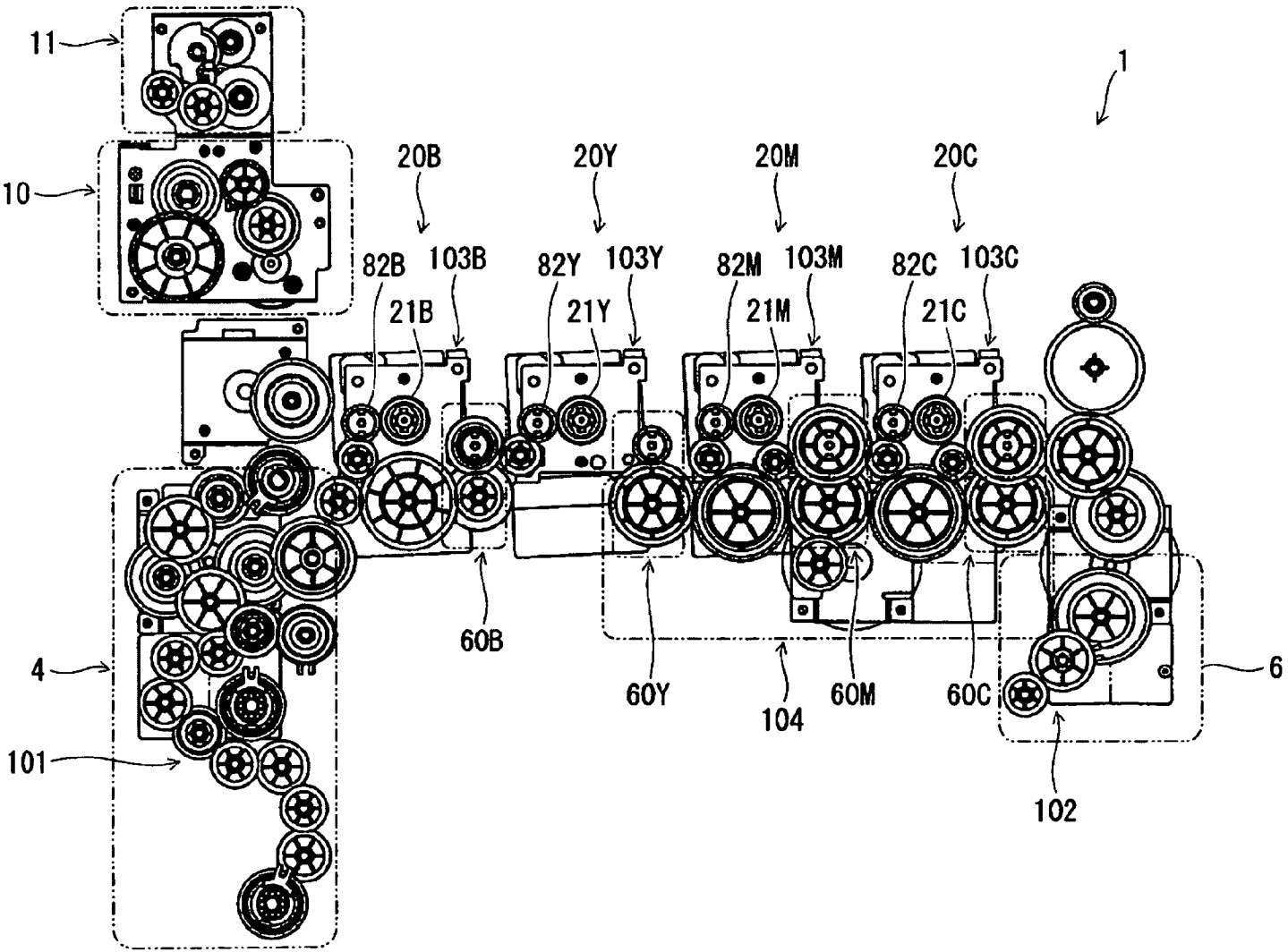
FIG. 3 is a front view showing driving mechanisms of the image forming apparatus of FIG. 1.
Figure 4:
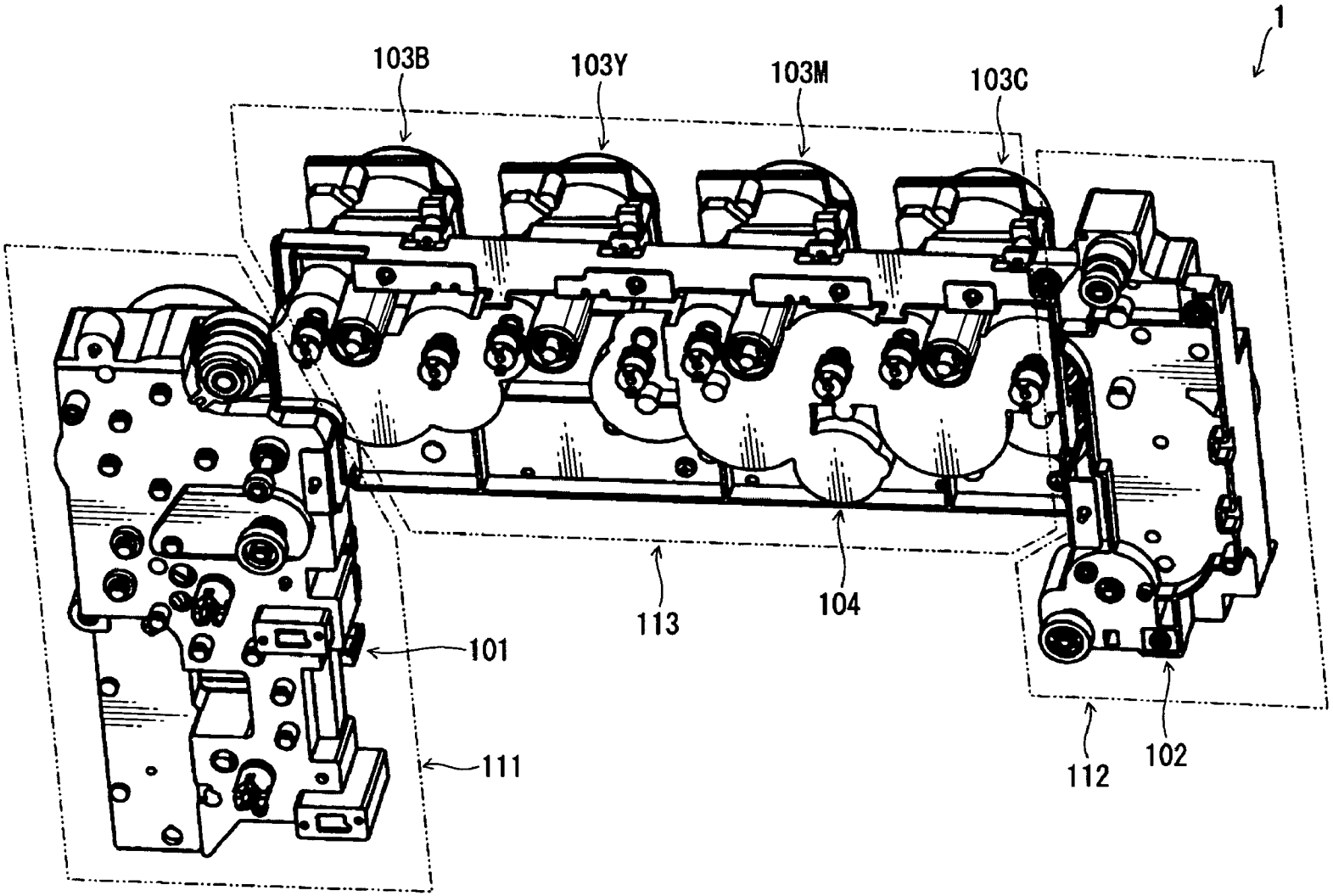
FIG. 4 is a perspective view showing driving units near sheet feeding sections and the image forming units.

Next, the construction of driving mechanism of the image forming apparatus 1 is described with reference to FIGS. 3 and 4 in addition to FIGS. 1 and 2. FIG. 3 is a front view showing driving mechanisms of the image forming apparatus 1, and FIG. 4 is a perspective view showing driving units near the sheet conveying portions and the image forming units. As described above, the identifying marks "C", "M", "Y" and "B" are left out in the following description unless it is necessary to particularly specify.

It should be noted that, in the image forming apparatus 1 of this embodiment having the above construction, driven members are the photoconductive drums 21, the developing devices 60 (developing rollers 61) and the cleaning roller 82 provided in the respective image forming units 20.

As shown in FIG. 3, the image forming apparatus 1 includes a first driving mechanism 101 for driving the first conveying members provided in the first sheet conveying section 4 and a second driving mechanism 102 for driving the second conveying members provided in the second sheet conveying section 6. The feed rollers, the pairs of conveyance rollers and the like provided in the respective sheet conveying sections are driven to rotate by the first and second driving mechanisms 101, 102. These first and second driving mechanisms 101, 102 include driving sources (first and second driving sources) such as motors, and power transmitting members (first and second driving members) such as gears and clutches for transmitting the driving forces of the first and second driving sources to the first and second conveying members.

For each image forming unit 20 is provided a drum driving mechanism 103 for driving the corresponding photoconductive drum 21. The drum driving mechanisms 103C, 103M, 103Y and 103B corresponding to the respective four colors are independent driving mechanisms different from the first and second driving mechanisms 101, 102.

Further, a developing-device driving mechanism 104 for commonly driving the developing devices 60C, 60M, 60Y of three colors is provided for the respective image forming units 20 for color toners. This developing-device driving mechanism 104 is an independent driving mechanism different from the first and second driving mechanisms 101, 102 and the drum driving mechanisms 103.

It should be noted that each of the drum driving mechanisms 103 and the developing-device driving mechanism 104 includes a driving source such as a motor and power transmitting members such as gears and clutches.

In FIG. 3, round members are either gears or clutches. Although the respective gears and clutches provided in these driving mechanisms 101 to 104 look as if being coupled to gears and clutches provided in the other driving mechanisms in FIG. 3, they are actually spaced apart in the depth direction of the plane of FIG. 3 and, hence, are not coupled. Therefore, the respective driving mechanisms independently transmit powers as described above.

Some of other driven members in the four image forming units 20 are driven by the first driving mechanism 101, and the others are driven by the second driving mechanism 102.

Specifically, the developing device 60B and the cleaning roller 82B of the black image forming unit 20B and the cleaning roller 82Y of the yellow image forming unit 20Y adjacent to the black image forming unit 20B are rotated by coupling gears (some of third driving members) for rotating these to the gears (first driving members) provided in the first driving mechanism 101.

Further, the cleaning roller 82M of the magenta image forming unit 20M and the cleaning roller 82C of the cyan image forming unit 20C are rotated by coupling gears (some of third driving members) for rotating these to the gears (second driving members) provided in the second driving mechanism 102.

As described above, the image forming apparatus 1 is provided with the sheet cassette 3 and the manual sheet feeding section 5 in or on which sheets P before printing are accommodated or placed in a stacked manner; the first sheet conveying section 4 for conveying the sheet P received from the sheet cassette 3; the second sheet conveying section 6 for conveying the sheet P received from the manual sheet feeding section 5; a plurality of image forming units 20 for forming toner images of different colors; the first driving mechanism 101 for driving the first conveying members provided in the first sheet conveying section 4; and the second driving mechanism 102 for driving the second conveying members provided in the second sheet conveying section 6. Since some of the driven members in the plurality of image forming units 20 are driven by the first driving mechanism 101 and others are driven by the second driving mechanism 102, it is not necessary to provide a driving mechanism anew for the image forming units 20. Further, such a complicated configuration of the power transmitting members as to transmit powers to parts relatively distant from the driving sources can be suppressed. This can promote lower costs and miniaturization, and enables the construction of the driving mechanisms having improved assemblability and maintainability. Thus, this can provide the image forming apparatus 1 in which the sheet conveying sections and the image forming units can be driven with suitable efficiency.

Further, the sheet cassette 3 as the first sheet feeding section is arranged at the bottom of the main body 2 of the image forming apparatus 1; the first sheet conveying section 4 is substantially vertically formed along the first surface of the main body 2; the manual sheet feeding section 5 as the second sheet feeding section is disposed at the second surface of the main body 2 opposite to the one where the first sheet conveying section 4 is formed; and the second sheet conveying section 6 substantially horizontally conveys the sheet P from the manual sheet feeding section 5 as the second sheet feeding section to the first sheet conveying section 4. In the image forming apparatus in which the substantially vertical first sheet conveying section 4 is formed for miniaturization and the second sheet conveying section 6 is so formed as not to make a curvature too large, it is not necessary to provide a driving mechanism anew for the image forming units 20 and such a complicated configuration of the power transmitting members as to transmit powers to parts relatively distant from the driving sources can be suppressed. Accordingly, the lower costs and the miniaturization of the image forming apparatus 1 can be promoted, and the driving mechanisms having improved assemblability and maintainability can be obtained. Thus, the sheet conveying sections and the image forming units can be driven with suitable efficiency.

Further, since the independent drum driving mechanisms 103 different from the first and second driving mechanisms 101, 102 are provided for the photoconductive drums 21 in the plurality of image forming units 20, the driving rotations of the respective photoconductive drums 21 can be individually controlled, and the influence of driving nonuniformity of the first and second driving mechanisms 101, 102 can be avoided. Therefore, the photoconductive drums 21 as the cores of the image formation can be driven with suitable efficiency and image quality can be improved.

The plurality of image forming units 20 include the single image forming unit 20B for black toner and a plurality of image forming units 20C, 20M, 20Y for color toners, and the developing-device driving mechanism 104 is provided which is common to all the developing devices 60C, 60M, 60Y provided in the plurality of image forming units 20C, 20M, 20Y for color toners and different from the first and second driving mechanisms 101, 102. Thus, the drive controls of the developing devices 60C, 60M, 60C for color toners can be performed separately from the drive control of the developing device 60B for black toner. This can prevent the developing devices 60C, 60M, 60Y for color toners from being driven at the time of single-color printing using only the black toner. Therefore, the plurality of image forming units 20 for forming black toner images and color toner images can be driven with suitable efficiency.

The plurality of image forming units 20 include the single image forming unit 20B for black toner and the plurality of image forming units 20C, 20M, 20Y for color toners, and the developing device 60B and the cleaning roller 82B of the image forming unit 20B for black toner are driven by the first driving mechanism 101 and the cleaning rollers 82C, 82M, 82Y of the image forming units 20C, 20M, 20Y for color toners are driven by the second driving mechanism 102. Thus, torque distribution to the cleaning rollers 82, which become loads on the driving mechanisms due to their cleaning mode to clean the photoconductive drums 21 while being held in pressing contact with the photoconductive drums 21, can be divided between the first and second driving mechanisms 101, 102. Accordingly, high torques are not necessary, with the result that the miniaturization and lower costs of the driving sources such as motors can be promoted in the first and second driving mechanisms 101, 102.

Here, when the respective image forming units 20 are started, the cleaning roller 82B of the black image forming unit 20B and the cleaning rollers 82C, 82M, 82Y of the color image forming units 20C, 20M, 20Y are respectively rotated in the directions opposite to those of the corresponding photoconductive drums 21 by the first and second driving mechanisms 101, 102 before the photoconductive drums 21 are rotated by the respective drum driving mechanisms 103. The circumferential speeds of the respective rollers 82 at this time are faster than those of the corresponding photoconductive drums 21.

By rotating the cleaning roller 82B of the black image forming unit 20B and the cleaning rollers 82C, 82M, 82Y of the color image forming units 20C, 20M, 20Y beforehand in this way, the cleaning rollers 82 can be prevented from becoming loads to the driving of the photoconductive drums 21 when the driving of the photoconductive drums 21 is started. Further, the rotations of the photoconductive drums 21 can be assisted by the rotations of the cleaning rollers 82. Accordingly, high-torque motors are not necessary for the driving of the photoconductive drums 21, wherefore the miniaturization and lower costs of the drum driving mechanisms 103 can be promoted and the photoconductive drums 21 can be driven with suitable efficiency. If the motors of the drum driving mechanisms 103 are stepping motors, they can be prevented from stepping out.

Further, by setting the circumferential speeds of the respective cleaning rollers 82 faster than those of the corresponding photoconductive drums 21, the action of the rotations of the cleaning rollers 82 to assist the rotations of the photoconductive drums 21 is improved. Therefore, the miniaturization and lower costs of the drum driving mechanisms 103 and the driving efficiency of the photoconductive drums 21 can be further improved.

As shown in FIG. 4, main components of the first driving mechanism 101 are united into a first driving unit 111. Similarly, main components of the second driving mechanism 102 are united into a second driving unit 112. On the other hand, the four drum driving mechanisms 103 and the developing-device driving mechanism 104 are united into a third driving unit 113.

Driving forces are transmitted to the cleaning rollers 82 of the respective image forming units 20 and the developing device 60B of the black image forming unit 20B shown in FIG. 3 by incorporating the first, second and third driving units 111, 112, 113 into the image forming apparatus 1 while coupling them to each other as shown in FIG. 4.

As described above, the first and second driving mechanisms 101, 102 are constructed as the first and second driving units 111, 112 independent of each other and the drum driving mechanisms 103 and the developing-device driving mechanism 104 are united into the third driving unit 113. Thus, the respective driving mechanisms are constructed as driving units including the driving sources and the power transmitting members such as motors, gears, belts and clutches. By unitizing the respective driving mechanisms in this way, assemblability and maintainability can be further improved.

The embodiment of the present invention is described above, but the scope of the present invention is not limited thereto and various changes can be made without departing from the gist of the invention.

For example, in the embodiment of the present invention, for the driving of the driven members of the four image forming units 20, the developing device 60B and the cleaning roller 82B of the black image forming unit 20B, and the cleaning roller 82Y of the yellow image forming unit 20Y are coupled to the first driving mechanism 101 and the cleaning roller 82M of the magenta image forming unit 20M and the cleaning roller 82C of the cyan image forming unit 20C are coupled to the second driving mechanism 102. However, a combination of the rotary members of the respective image forming units 20 and the driving mechanism therefor is not limited to this, and another combination may be adopted.

The aforementioned specific embodiment mainly embraces features of the inventions having the following constructions.

An image forming apparatus according to one aspect of the present invention comprises a first and a second sheet feeding sections for accommodating sheets before printing in a stacked manner; a first sheet conveying section including first conveying members and adapted to convey a sheet received from the first sheet feeding section; a second sheet conveying section including second conveying members and adapted to convey a sheet received from the second sheet feeding section; a plurality of image forming units each including driven members and adapted to form a toner image of a different color; a first driving source for driving the first conveying members; and a second driving source for driving the second conveying members, some of the driven members being driven by the first driving source and others being driven by the second driving source.

With this construction, it is not necessary to provide a driving mechanism anew for the driven members of the image forming units. Further, such a complicated configuration of the power transmitting members as to transmit powers to parts relatively distant from the driving sources can be suppressed. This can promote lower costs and miniaturization, and enables driving mechanisms to have improved assemblability and maintainability. In addition, this can provide an image forming apparatus in which the sheet conveying sections and the image forming units can be driven with suitable efficiency.

In the above construction, it is preferable that a box-shaped image forming apparatus main body containing the above respective components and having a first and a second surfaces opposed to each other is further provided; that the first sheet feeding section is arranged at a bottom part of the image forming apparatus main body; that the first sheet conveying section is substantially vertically formed along the first surface; that the second sheet feeding section is disposed at the second surface; and that the second sheet conveying section substantially horizontally conveys a sheet from the second sheet feeding section to the first sheet conveying section.

With this construction, if the substantially vertical first sheet conveying section is formed for miniaturization and the second sheet conveying section is so formed as not to make a curvature too large, it is not necessary to provide a driving mechanism anew for the image forming units, and the lower costs and the miniaturization of the image forming apparatus can be promoted.

In the above construction, it is preferable that first driving members for transmitting a driving force of the first driving source to the first conveying members, second driving members for transmitting a driving force of the second driving source to the second conveying members and third driving members for the respective driven members are further provided, and that the first driving members and some of the third driving members are so coupled as to be able to transmit the driving force while the second driving members and others of the third driving members are so coupled as to be able to transmit the driving force.

With this construction, the driving forces of the first and second driving sources can be securely transmitted to the first and second conveying members utilizing the first to third driving members.

It is preferable to further comprise photoconductive drums respectively included in the plurality of image forming units, and independent drum driving mechanisms for individually driving the respective photoconductive drums by driving sources different from the first and second driving sources.

With this construction, the driving rotations of the respective photoconductive drums can be individually controlled and the influence of driving nonuniformity of the first and second driving sources can be avoided. Therefore, the photoconductive drums as the cores of the image formation can be driven with suitable efficiency and image quality can be improved.

It is also preferable to further comprise developing devices respectively included in the plurality of image forming units, and a developing-device driving mechanism for driving some or all of the developing devices by a driving source different from the first and second driving sources. In this case, it is preferable that the plurality of image forming units include a single image forming unit for black toner and a plurality of image forming units for color toners; and that the developing-device driving mechanism is a driving mechanism for commonly driving all the developing devices included in the plurality of image forming units for color toners.

With this construction, the driving of the developing devices for color toners and that of the developing device for black toner can be separately controlled. Thus, the driving of the developing devices for color toners can be prevented at the time of single-color printing using only the black toner. Therefore, the plurality of image forming units for forming black toner images and color toner images can be driven with suitable efficiency.

In the above construction, it is preferable that each of the plurality of image forming units includes a cleaning roller; and that the driven members are the cleaning rollers.

It is preferable that developing devices respectively included in the plurality of image forming units and cleaning rollers respectively included in the plurality of image forming units are further provided; that the plurality of image forming units include a single image forming unit for black toner and a plurality of image forming units for color toners; and that at least one of the developing device and the cleaning roller of the image forming unit for black toner and the respective cleaning rollers of the image forming units for color toners is driven by the first driving source, and the others are driven by the second driving source.

With this construction, torque distribution to the cleaning rollers, which become loads on the driving mechanisms due to their cleaning mode to clean the photoconductive drums while being held in pressing contact with the photoconductive drums, can be divided between the first and second driving sources. Accordingly, high torques are not necessary, with the result that the miniaturization and lower costs of the first and second driving sources can be promoted.

It is particularly preferable that the image forming units for color toners are three image forming units; that the developing device and the cleaning roller of the image forming unit for black toner and the cleaning roller of the image forming unit for color toner adjacent to the image forming unit for black toner are driven by the first driving source; and that the cleaning rollers of the remaining two image forming units for color toners are driven by the second driving sources.

With this construction, the torque distribution of the first and second driving sources can be equalized.

In the above construction, it is preferable to rotate the cleaning roller of the image forming unit for black toner and the cleaning rollers of the image forming units for color toners by the first and second driving sources prior to the rotations of the photoconductive drums when the plurality of image forming units are started.

With this construction, the cleaning rollers can be prevented from becoming loads to the driving of the photoconductive drums when the driving of the photoconductive drums is started. Further, the rotations of the photoconductive drums can be assisted by the rotations of the cleaning rollers. Accordingly, high-torque motors are not necessary for the driving of the photoconductive drums, wherefore the miniaturization and lower costs of the drum driving mechanisms can be promoted and the photoconductive drums can be driven with suitable efficiency.

In this case, the circumferential speeds of the respective cleaning rollers are preferably faster than those of the corresponding photoconductive drums. Then, the action of the rotations of the cleaning rollers to assist the rotations of the photoconductive drums is improved. Therefore, the miniaturization and lower costs of the drum driving mechanisms and the driving efficiency of the photoconductive drums can be further improved.

In the above construction, it is preferable to further comprise photoconductive drums respectively included in the plurality of image forming units; independent drum driving mechanisms for individually driving the respective photoconductive drums by driving sources different from the first and second driving sources; developing devices respectively included in the plurality of image forming units; and a developing-device driving mechanism for driving some or all of the developing devices by a driving source different from the first and second driving sources.

In the above construction, it is preferable to further comprise the following independent three driving units: a first driving unit including the first driving source, a second driving unit including the second driving source, and a third driving unit including the drum driving mechanisms and the developing-device driving mechanism.

With this construction, the respective driving mechanisms are constructed as individual and independent driving units including the driving sources and the power transmitting members such as motors, gears, belts and clutches. By unitizing the respective driving mechanisms in this way, assemblability and maintainability can be further improved.

Further in the above construction, it is preferable that the plurality of image forming units include a single image forming unit for black toner and three image forming units for color toners; that the developing device and the cleaning roller of the image forming unit for black toner and the cleaning roller of the image forming unit for color toner adjacent to the image forming unit for black toner are driven by the first driving source; that the cleaning rollers of the remaining two image forming units for color toners are driven by the second driving sources; and that all the developing devices of the image forming units for color toners are commonly driven by the developing-device driving mechanism.

This application is based on patent application No. 2006-123738 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus, comprising:

a first and a second sheet feeding sections for accommodating sheets before printing in a stacked manner;

a first sheet conveying section including first conveying members and adapted to convey a sheet received from the first sheet feeding section;

a second sheet conveying section including second conveying members and adapted to convey a sheet received from the second sheet feeding section;

a single first image forming unit for forming a black toner image, and including a first photoconductive drum, a first developing device, and a first cleaning roller as driven members;

a plurality of second image forming units for forming color toner images and including second photoconductive drums, second developing devices, and second cleaning rollers as driven members;

a controlling unit for controlling operations of the first image forming unit and the second image forming units;

a first driving source for driving the first conveying members; and a second driving source for driving the second conveying members, wherein at least one of the first developing device, the first cleaning roller, and the second cleaning rollers is driven by the first driving source, and the rest of the first developing device, the first cleaning roller and the second cleaning rollers that is not driven by the first driving source is driven by the second driving source, rotational directions of the first and second cleaning rollers are opposite to those of the first and second photoconductive drums, and the controlling unit performs a driving control of rotating the first cleaning roller and the second cleaning rollers by the first driving source and the second driving source prior to the rotations of the first photoconductive drum and the second conductive drums when the first image forming unit and the second image forming units are started.

2. An image forming apparatus according to claim 1, further comprising a box-shaped image forming apparatus main body containing the respective components and having a first and a second surfaces opposed to each other, wherein:

the first sheet feeding section is arranged at a bottom part of the image forming apparatus main body;

the first sheet conveying section is substantially vertically formed along the first surface;

the second sheet feeding section is disposed at the second surface; and the second sheet conveying section substantially horizontally conveys a sheet from the second sheet feeding section to the first sheet conveying section.

3. An image forming apparatus according to claim 1, further comprising:

first driving members for transmitting a driving force of the first driving source to the first conveying members;

second driving members for transmitting a driving force of the second driving source to the second conveying members and third driving members provided for the respective first and second photoconductive drums, the respective first and second developing devices, and the respective first and second cleaning rollers, wherein the first driving members and some of the third driving members are so coupled as to be able to transmit the driving force while the second driving members and others of the third driving members are so coupled as to be able to transmit the driving force.

4. An image forming apparatus according to claim 1, further comprising:

independent drum driving mechanisms for individually driving the first and second photoconductive drums by driving sources different from the first and second driving sources.

5. An image forming apparatus according to claim 1, further comprising:

developing devices respectively included in the plurality of image forming units; and a developing-device driving mechanism for driving at least one of the first and second developing devices by a driving source different from the first and second driving sources.

6. An image forming apparatus according to claim 5, wherein:

the developing-device driving mechanism is a driving mechanism for commonly driving all the second developing devices respectively included in the second image forming units.

7. An image forming apparatus according to claim 1, wherein:

the second image forming units are composed of three image forming units;

the first developing device and the first cleaning roller, and the second cleaning roller of the one second image forming unit adjacent to the first image forming unit are driven by the first driving source; and the second cleaning rollers of the remaining two second image forming units are driven by the second driving sources.

8. An image forming apparatus according to claim 1, wherein the circumferential speeds of the respective cleaning rollers are faster than those of the corresponding photoconductive drums.

9. An image forming apparatus according to claim 1, further comprising:

independent drum driving mechanisms for individually driving the first and second photoconductive drums by driving sources different from the first and second driving sources;

a developing-device driving mechanism for driving at least one of the first and second developing devices by a driving source different from the first and second driving sources.

10. An image forming apparatus according to claim 9, further comprising:

a first driving unit including the first driving source;

a second driving unit including the second driving source; and a third driving unit including the drum driving mechanisms and the developing-device driving mechanism, the first to third driving units being independent of each other.

* * * * *